US008657244B2

(12) United States Patent
Sillik

(10) Patent No.: US 8,657,244 B2
(45) Date of Patent: Feb. 25, 2014

(54) SUPPORT HANGER FOR INSULATION AND OTHER MATERIALS

(76) Inventor: Francisco J. Sillik, Tucson, AZ (US)

( * ) Notice: Subject to any disclaimer, the term of this patent is extended or adjusted under 35 U.S.C. 154(b) by 73 days.

(21) Appl. No.: 12/432,634

(22) Filed: Apr. 29, 2009

(65) Prior Publication Data

US 2010/0276559 A1 Nov. 4, 2010

(51) Int. Cl.
*E04G 5/06* (2006.01)
*F16M 11/00* (2006.01)

(52) U.S. Cl.
USPC ..... 248/217.3; 248/300; 248/684; 411/461

(58) Field of Classification Search
USPC ..... 248/216.1, 217.3, 218.2, 218.3, 309.1, 248/546, 684, 690, 473, 477, 488, 497, 300, 248/301, 339; 411/439, 461, 457
See application file for complete search history.

(56) References Cited

U.S. PATENT DOCUMENTS

| | | | | | |
|---|---|---|---|---|---|
| 3,865,342 | A * | 2/1975 | Kanzelberger | ..... | 248/470 |
| 4,762,162 | A * | 8/1988 | Chochrek | ..... | 248/266 |
| 5,152,117 | A * | 10/1992 | Wynar | ..... | 52/712 |
| 5,386,959 | A * | 2/1995 | Laughlin et al. | ..... | 248/205.1 |
| 5,454,542 | A * | 10/1995 | Hart | ..... | 248/494 |
| 5,924,246 | A * | 7/1999 | Jurgens et al. | ..... | 248/317 |
| 6,250,541 | B1 * | 6/2001 | Shangguan et al. | ..... | 228/208 |
| 6,279,286 | B1 * | 8/2001 | Ichihashi | ..... | 248/218.4 |
| 6,416,269 | B1 * | 7/2002 | Martel et al. | ..... | 411/461 |
| 6,543,737 | B2 * | 4/2003 | Decker et al. | ..... | 248/316.1 |
| 6,766,992 | B1 * | 7/2004 | Parker | ..... | 248/300 |
| 7,717,387 | B2 * | 5/2010 | Naheem | ..... | 248/316.7 |

* cited by examiner

*Primary Examiner* — Tan Le
(74) *Attorney, Agent, or Firm* — Quarles & Brady LLP; Gavin J. Milczarek-Desai

(57) ABSTRACT

An article for supporting a material that includes a hanger of rigid material, with the hanger including a first planar portion connected to an offset but parallel second planar portion by a planar shoulder disposed perpendicularly to both the first and second planar portions and further including at least one spike disposed upon a front surface of the first planar portion and at least one notch disposed upon a side surface of the second planer portion. A pair of hangers may be used to form a shelf-like support through connecting the pair of hangers with a wire or filament engaged within a notch, a barb, or both.

6 Claims, 1 Drawing Sheet

SUPPORT HANGER FOR INSULATION AND OTHER MATERIALS

BACKGROUND OF THE INVENTION

The invention relates generally to supporting structures and more particularly to support structures or hangers that are especially useful to support insulation.

Description of the Related Art

Insulation installed underneath a roof is typically placed between two studs or beams. Moreover, wall insulation (or specialized insulation such as sound proofing materials) is often laid between studs from long rolls or long strips. The insulation typically is prevented from sagging or falling by wire hangers which extend from one stud to the other and are anchored in the studs.

Alternatively, some insulation installers simply string a wire or other filament between two nails that have been tacked into parallel studs. This arrangement is fast and comparatively easy.

Both the use of typical wire hangers and of "nail and wire" supports have some drawbacks. For example, the pointed ends or prongs of some wire hangers occasionally become unseated, thereby allowing the material that is being supported to sag and loose some of its function (e.g., reduction of the R-value of insulation through compaction), or worse, loosen or break (e.g., if ducts or pipes are being supported). Wire hangers also can deform and cause insulation to sag. Similarly, a wire strung between two nails does not always hold the supported material (e.g., insulation) in a manner that prevents sagging (or the wire becomes undone from the nail), which leads to the creation of uninsulated air pockets. Given the need to conserve energy and the expense involved in replacing improperly installed or sagging insulation, improvements in support hangers continue to be needed.

Thus, it continues to be desirable for there to be a support member or hanger that is easily and securely fastened to a variety of joist or wooden stud structures and that better prevents the sagging of supported materials, such as insulation.

SUMMARY OF THE INVENTION

The invention relates in general to an article for holding a material in place that includes a hanger of rigid material. The hanger includes a first planar portion connected to an offset but parallel second planar portion by a planar shoulder disposed perpendicularly to both the first and second planar portions, thus approximating a "stepped" or "staggered" appearance in side view as shown in FIG. 1. The hanger further includes at least one spike disposed upon a front surface of the first planar portion and at least one notch disposed upon a side surface of the second planer portion.

In another embodiment, the invention relates to hanger similar in structure to that disclosed above and further including both at least one notch disposed upon a side surface of the second planer portion and at least one barb disposed upon a front surface of the second planer portion.

In another embodiment, the hanger includes a pair of notches disposed at a same height along opposite sides of the second planer portion. Preferably, a plurality of pairs of notches are provided, with each pair of notches being disposed along opposite sides of the second planer portion and spaced at intervals corresponding to standard units of measurement.

In yet another embodiment, a pair of hangers of the invention are disclosed, with a wire or filament connecting the pair of hangers and forming a shelf-like support for insulation and the like.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

Figure 1:
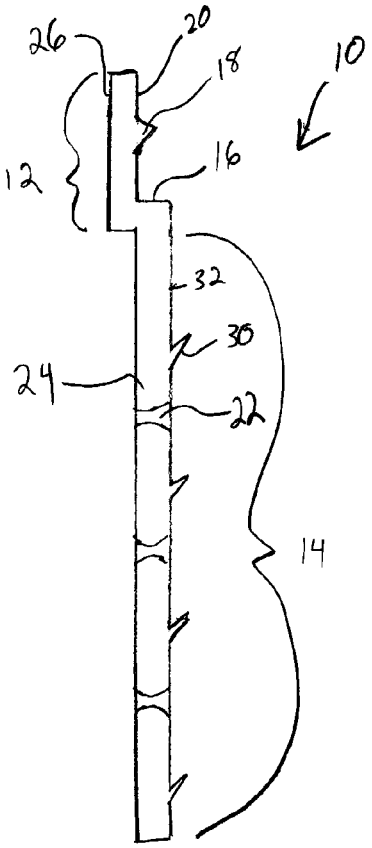
FIG. 1 is an elevational side view of an article in accordance with the invention.
Figure 2:
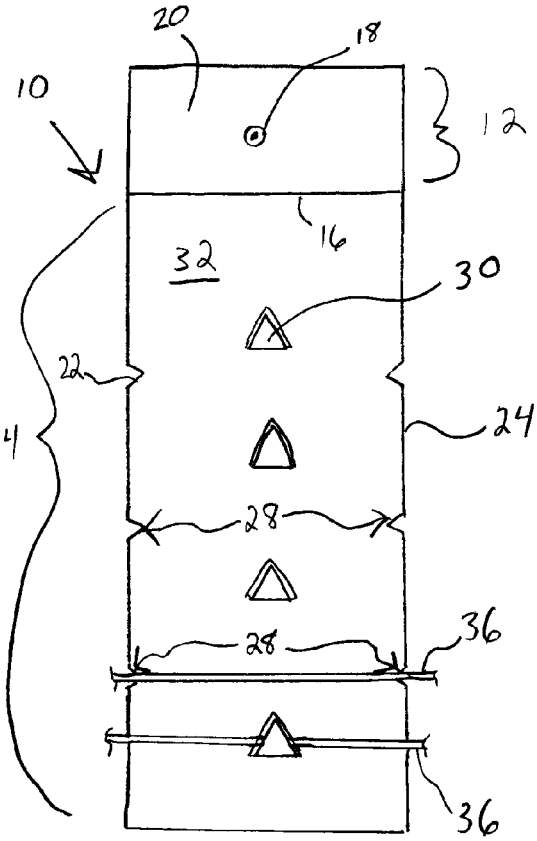
FIG. 2 illustrates in front elevational view the embodiment of the article shown in FIG. 1.

Referring to FIGS. 1 and 2, the numeral 10 identifies a hanger article in accordance with the invention for holding or confining a material such as insulation. The hanger is made of rigid material, preferably of metal and preferably of one-piece construction such at assembly or other modifications by users is unnecessary. Hanger 10 includes a first planar portion 12 connected to an offset but parallel second planar portion 14 by a planar shoulder 16 disposed perpendicularly to both planar portions 12 and 14 as shown in FIG. 1.

Planar portion 12 further includes at least one spike 18 disposed upon a front surface 20 and at least one notch 22 disposed upon a side surface 24 of planer portion 14. The spike of hanger 10 is driven into a beam (such as a wooden stud), thereby securing the hanger to the beam. Moreover, the shoulder 16 seats the hanger 10 firmly against a beam (not shown), while simultaneously offsetting (i.e., staggering) portion 12 from portion 14, thereby providing a striking area on the back surface 26 of portion 12 from which the spike 18 is driven into the beam.

Preferably, hanger 10 includes a pair of notches 28 disposed at a same height along opposite sides of planer portion 14. Even more preferably, hanger 10 includes a plurality of pairs of notches 28, with each pair of notches being disposed at a height along opposite sides of planar portion 14 and spaced at intervals corresponding to standard units of measurement (e.g., inches). Thus, a hanger user who is installing insulation, or an inspector, can readily see the depth of insulation applied and determine is there is a correspondence with that called for in the building plans.

Preferably, hanger 10 also includes at least one barb 30 disposed upon the front surface 32 of planer portion 14. Barb 30, which is a partial triangular cut-out in front surface 32 in this embodiment, is adapted to engage a material, such as insulation (not shown) or a wire/filament 36. By engaging a sheet of insulation, barb 30 helps to keep the sheet from sagging.

Figure 3:
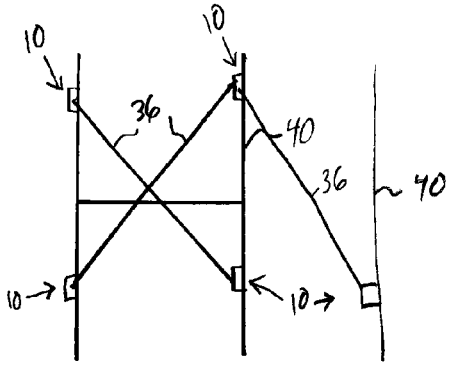
FIG. 3 is a simplified schematic view of a third embodiment of the invention showing a pair of hangers attached to studs of wood and connected by a wire or filament, thereby forming a shelf-like support.

As seen in FIG. 3, a pair of hangers 10 of the invention and a wire or filament 36 are connected to form a shelf-like support for insulation or other objects or materials when the pair of hangers 10 are attached to beam 40.

The wire or filament 36 may be engaged within a notch 22 or pair of notches 28 on each pair of hangers 10. Alternatively, or in addition, the wire or filament 36 may be engaged within a barb 30 on the pair of hangers 10. In either case, the wire or filament is secured to the hanger 10 such that it is unlikely to slip over time, thereby providing a redundant "anti-sagging" measure. Moreover, the hangers 10 will not deform or break, given their one-piece rigid (preferably metal) construction.

Various changes in the details and components that have been described may be made by those skilled in the art within the principles and scope of the invention herein described in the specification and defined in the appended claims. For example, the hangers of the invention may be used to "double stack" insulation (i.e., hang a second layer of insulation) where previously installed insulation is inadequate or has become compressed and lost some of its "R-value." Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. An article for holding a material in place, comprising:

a hanger of rigid material, said hanger including a first planar portion connected to an offset but parallel second planar portion by a planar shoulder disposed perpendicularly to both said first and second planar portions, said hanger further including a pair of notches disposed at a same height along opposite sides of said second planer portion, wherein said hanger is of one-piece construction, said first planar portion and said second planar portion are parallel to each other along their entire respective lengths, and said second planar portion extends away from said first planar portion.

2. The article of claim 1, wherein said hanger includes a plurality of pairs of notches, with each pair of notches being disposed at a height along opposite sides of said second planer portion and spaced at intervals corresponding to standard units of measurement.

3. The article of claim 1, wherein said second planer portion further includes at least one barb centrally disposed upon a front surface thereof.

4. The article of claim 1, wherein said second planer portion further includes a plurality of barbs centrally disposed upon a front surface thereof.

5. An article for holding a material in place, comprising:

a hanger of rigid material, said hanger including a first planar portion connected to an offset but parallel second planar portion by a planar shoulder disposed perpendicularly to both said first and second planar portions, said hanger further including at least one barb centrally disposed upon a front surface of said second planer portion, wherein said hanger is of one-piece construction, said first planar portion and said second planar portion are parallel to each other along their entire respective lengths, and said second planar portion extends away from said first planar portion.

6. The article of claim 5, wherein said second planer portion includes a plurality of barbs centrally disposed upon a front surface thereof.

* * * * *